US010433066B1

(12) United States Patent
Xue et al.

(10) Patent No.: US 10,433,066 B1
(45) Date of Patent: Oct. 1, 2019

(54) MICRO PLANAR SPEAKER

(71) Applicant: Hong Xue, Suining, Sichuan Province (CN)

(72) Inventors: Hong Xue, Suining (CN); Nianwei Yang, Shenzhen (CN)

(73) Assignee: Hong Xue, Suining, Sichuan Province (CN)

( * ) Notice: Subject to any disclaimer, the term of this patent is extended or adjusted under 35 U.S.C. 154(b) by 0 days.

(21) Appl. No.: 16/158,251

(22) Filed: Oct. 11, 2018

(30) Foreign Application Priority Data

Mar. 26, 2018 (CN) ..... 2018 1 0252738

(51) Int. Cl.

| | |
|---|---|
| ***H04R 9/04*** | (2006.01) |
| ***H04R 1/10*** | (2006.01) |
| ***H04R 9/02*** | (2006.01) |
| ***H04R 3/00*** | (2006.01) |
| ***H04R 9/06*** | (2006.01) |

(52) U.S. Cl.
CPC ..... *H04R 9/047* (2013.01); *H04R 1/1016* (2013.01); *H04R 3/002* (2013.01); *H04R 9/025* (2013.01); *H04R 9/06* (2013.01)

(58) Field of Classification Search
CPC ..... H04R 9/047; H04R 9/06; H04R 3/002; H04R 1/1016; H04R 9/025; H04R 11/00; H04R 11/02; H04R 13/00; H04R 7/04; H04R 9/02; G10K 11/002; G10K 11/004
USPC ..... 381/431
See application file for complete search history.

(56) References Cited

U.S. PATENT DOCUMENTS 3,898,598 A * 8/1975 Asahi ..... H04R 9/047 335/231
3,939,312 A * 2/1976 McKay ..... H04R 9/047 381/408
4,242,541 A * 12/1980 Ando ..... H04R 9/047 381/182
4,468,530 A * 8/1984 Torgeson ..... H04R 9/047 381/402
4,480,155 A * 10/1984 Winey ..... H04R 9/047 381/408
4,837,838 A * 6/1989 Thigpen ..... H04R 9/047 181/172
5,003,609 A * 3/1991 Muraoka ..... H04R 9/047 381/117
5,003,610 A * 3/1991 Adachi ..... H04R 9/047 381/413
5,021,613 A * 6/1991 Garcia ..... H04R 9/048 381/399
5,297,214 A * 3/1994 Bruney ..... H04R 7/10 381/408
5,361,304 A * 11/1994 Jones ..... H04R 1/1083 381/401

(Continued)

*Primary Examiner* — Oyesola C Ojo
(74) *Attorney, Agent, or Firm* — Cheng-Ju Chiang

(57) ABSTRACT

A micro speaker includes a planar diaphragm, spacers respectively disposed at one side surface of the planar diaphragm, an upper plate and a lower plate, one or more magnets and a circuit board. The planar diaphragm includes a vibrating diaphragm and a coil conductor. The coil conductor is stretched and bonded onto the vibrating diaphragm via an adhesive layer on the upper side surface of the planar diaphragm; the coil conductor is electrically connected to the circuit board. The speaker in this present invention can get a diameter of 15 mm or less, and a height is 5 mm or less.

20 Claims, 7 Drawing Sheets

(56) References Cited

U.S. PATENT DOCUMENTS

| | | | | |
|---|---|---|---|---|
| 6,963,654 | B2 * | 11/2005 | Sotme | H04R 7/04 381/399 |
| 7,236,608 | B2 * | 6/2007 | Garner | B60R 11/0223 381/399 |
| 8,116,512 | B2 * | 2/2012 | Levitsky | H04R 9/025 381/399 |
| 2001/0005419 | A1 * | 6/2001 | Kermani | H04R 7/04 381/189 |
| 2011/0274309 | A1 * | 11/2011 | Doh | H04R 9/047 381/398 |
| 2016/0057544 | A1 * | 2/2016 | Chamarthy | H04R 9/046 381/410 |

* cited by examiner

MICRO PLANAR SPEAKER

FIELD OF THE INVENTION

The present invention relates to the field of sound elements or equipments, and especially for a micro planar speaker.

BACKGROUND OF THE INVENTION

A vibrating diaphragm of a traditional speaker includes the coil conductor made of aluminum foil, and has a large diameter, thus has a large area, and a size of the vibrating diaphragm is 20 mm×20 mm or more. Further, the vibrating diaphragm usually adopts a double-ended magnetic structure, which increases the thickness of the speaker. Such planar speakers have large sizes and volumes, most are suitable for headphones or flat supra-aural headphones, but not suitable for insert earphones, mobile phones, or tablet computers, yet cannot be widely used.

Therefore, an improved micro speaker is desired which overcomes the disadvantages of the prior art.

SUMMARY OF THE INVENTION

A main object of the present invention is to provide a micro planar speaker, to solve the problem of the existing speaker with a large size and volume.

to obtain the above object, a micro planar speaker in accordance with the present invention comprises: a planar diaphragm with an upper side surface and an opposite lower side surface; an upper and a lower spacers respectively disposed at the upper side surface and the lower side surface of the planar diaphragm, and each defining a cavity so as to form a magnetic gap at the side surface of the planar diaphragm; an upper plate and a lower plate respectively disposed on top of the upper spacer and below the lower spacer; one or more magnets; and a circuit board. The planar diaphragm comprises a vibrating diaphragm and one or more coil conductor; the coil conductor is stretched and bonded onto the vibrating diaphragm via an adhesive layer on one side surface of the planar diaphragm; opposite ends of one coil conductor respectively form a positive electrode and a negative electrode to electrically connect with the circuit board.

Preferably, a layout or pattern of the coil conductor is adapted to the magnets, and comprises one or more voice coils via the coil conductor winding; each voice coil corresponds to one magnet to form one sound unit; the magnet is arranged above or below the corresponding voice coil; and the coil conductor is a continuous conductive line.

Preferably, the layout or pattern of the coil conductor depends on a size of the speaker, and also depends on shape, number, arrays and arrangement the magnets; each voice coil includes one loop or sets of parallel loops of the conductive line, and defines a space inside the loop or loops.

Preferably, the loop or loops have one side thereof open to communicate with the space, whereby each loop is unclosed and is open at the same side; each loop is adapted to an outer contour of the corresponding magnet below or upon, and is arranged around the corresponding magnet; and the corresponding magnet is aligned to the voice coil.

Preferably, a first loop of conductive line in the voice coil is the most inner loop and encloses the space; one end of the coil conductor continuously winds to form all first loops of all voice coils one by one, and further winds outer parallel loops sequentially; the most outer loops finally extends to the other opposite end of the coil conductor; the loops in of the same voice coil are spaced each other, and are equally spaced.

Preferably, the voice coil has a dimension larger than the magnet; the magnets keep all N poles oriented towards the coil conductor or all S poles oriented towards the coil conductor; the voice coil is in a shape of a letter U according to one or more bar magnets, or the voice coil has unclosed regular shape or unclosed irregular shape according to the magnets with regular shape or irregular shape.

Preferably, the positive electrode and negative electrode at opposite ends of the coil conductor are arranged opposite to each other at an edge of the planar diaphragm, and each has an enlarged electric area for facilitating electric connection with the circuit board; and the positive electrode and negative electrode of the coil conductor are arranged on the upper side surface of the planar diaphragm.

Preferably, the upper and lower plates are made of magnetically conductive material; perforations through each plate are provided to allow air and sound waves to pass through, and are communicated with the cavity in the spacer at the same side surface of the planar diaphragm; and each plate has flat top and bottom surfaces.

Preferably, the speaker further comprises a magnet support; the magnet support defines a center cavity therethrough which is communicated with the cavity in the spacer at the same side surface of the planar diaphragm to allow air and sound waves to pass through; and the magnets are parallel arranged in the center cavity with a space therebetween and being communicated with and aligned to the perforation in the plate; the magnet support is mounted between the upper plate and the upper spacer; the magnet support has its top surface bonded to a lower surface of the upper plate to form a whole piece for an easy assembly.

Preferably, the positive electrode and negative electrode of the coil connector are electrically connected to the circuit board each by an elastic conductor; the circuit board has a pair of electric contacts for electrically connecting with the positive electrode and negative electrode.

Preferably, the pair of electric contacts is set on a rear surface of the circuit board; a positive terminal and a negative terminal are set on a top surface of the circuit board and used for electric connection with a sound equipment in which the speaker is mounted; the positive terminal and negative terminal are respectively electrically connected with the electric contacts; the circuit board is set on top of the upper plate.

Preferably, a plated-through hole is defined in each electric contact as so to form electric conductivity in the plated-through hole; the positive terminal and negative terminal are respectively electrically connected with one plated-through hole via electric lines on the top surface of the circuit board and thus electrically connect with the pair of electric contacts on the rear surface of the circuit board.

Preferably, the positive terminal and negative terminal are configured as soldering points for soldering connection; the positive terminal and negative terminal are treated via gold-plating or immersion-gold process so as to improve electric conductivity; the positive terminal and negative terminal each has an enlarged electric area for facilitating electric connection.

Preferably, the electric contacts are respectively aligned to and face the positive electrode and negative electrode of the coil conductor on the planar diaphragm; opposite ends of each elastic conductor are respectively resisted against one electric contact on the rear surface of the circuit board and one of the positive and negative electrodes of the coil conductor on the planar diaphragm.

Preferably, the elastic conductor is a compressible spring; the upper plate, and/or magnet support and/or the upper spacer respectively define through holding holes for holding the spring therein; one set of through holding holes are aligned each other to form one accommodating space for holding one spring and located between one electric contact and the positive electrode; the other set of through holding holes are aligned each other to form the other accommodating space for holding the other spring and located between the other electric contact and the negative electrode.

Preferably, an insulating ring is further set around the spring; the micro planar speaker further comprises a damper on its top and a dustproof net at its bottom; the damper is made of a breathable member.

Preferably, the circuit board defines through perforations communicated with the cavity in the upper spacer to allow air and sound waves to pass through; the circuit board, upper plate, magnet support, upper spacer, planar diaphragm, lower spacer, and lower plate are fastened together successively; a fastener is passed through a plurality of aligned holes disposed in the circuit board, upper plate, magnet assembly, upper spacer, planar diaphragm, lower spacer, and lower plate respectively for fixation.

Preferably, the micro planar speaker has a diameter of 15 mm or less, and/or a plane length and width each equal to or less than 15 mm, and/or a height is 5 mm or less; the speaker has a frequency spectrum of 20 Hz-40 KHz and 50 Hz-3 KHz, and has a sound distortion less than 1%; a total thickness of the planar diaphragm can be or less than 10 micrometers.

Preferably, the coil conductor is made from copper; the vibrating diaphragm is made from a thin film.

Preferably, wherein the coil conductor is made from annealed copper or electrolytic copper foil via etching way; and the vibrating diaphragm is made from PET film.

Other features and advantages of the invention will be apparent with reference to the following detailed description, taken together with the appended drawings, both of which are given by way of example, and not by way of limitation.

DETAILED DESCRIPTION OF PREFERRED EMBODIMENTS

Figure 1:
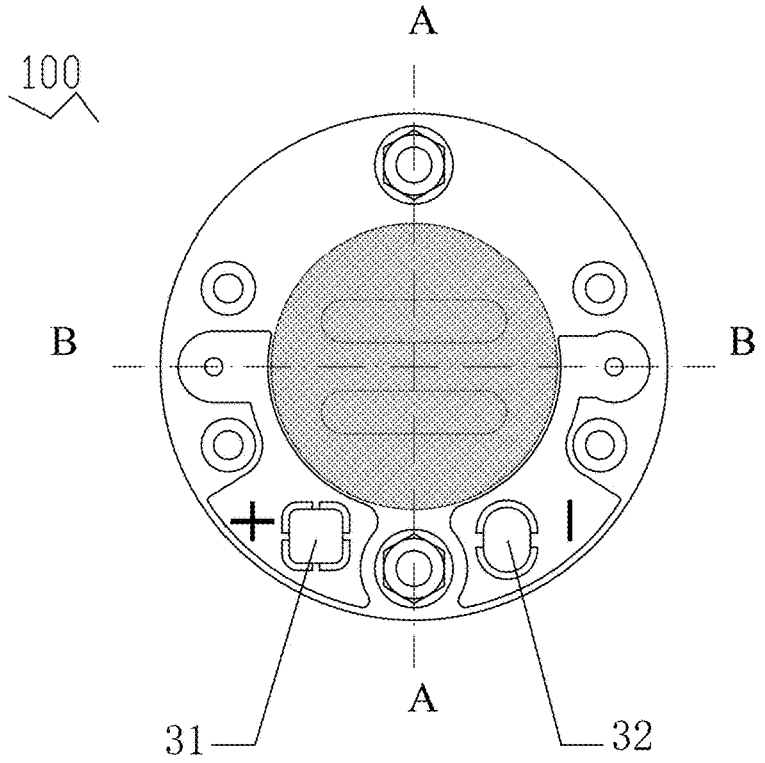
FIG. 1 is a front view of a micro planar speaker in accordance with an embodiment of the present invention.
Figure 2:
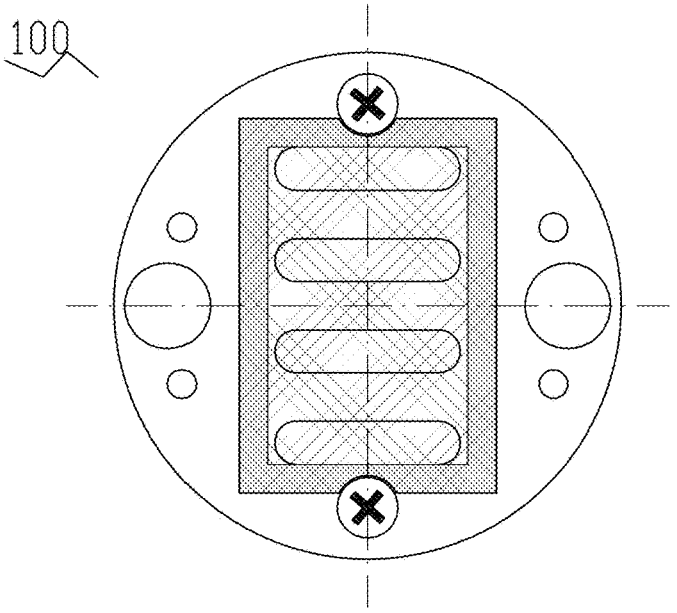
FIG. 2 is a rear view of the micro planar speaker in accordance with the embodiment of the present invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended.

Referring to FIGS. 1-10, a micro planar speaker 100 provided in accordance with an embodiment of the present invention, comprises a planar diaphragm 10, spacers 9, 19, plates 5, 15, magnets 7 mounted in a support structure 8, and a circuit board 3. Where an upper spacer 9 together with an upper plate 5 thereon is disposed at an upper side surface 102 of the planar diaphragm 10, and defines a cavity 90 above the upper side surface 102 of the planar diaphragm 10 so as to form a magnetic gap. A lower spacer 19 together with a lower plate 15 below is disposed at an opposite lower side surface 103 of the planar diaphragm 10, and also defines a cavity 90 below the lower side surface 103 of the planar diaphragm 10 so as to form another magnetic gap. At least one cavity 90 at the side surface 102/103 is inserted magnets 7. In accordance with one embodiment of the present invention, the magnets 7 is inserted in the cavity 90 above the upper side surface 102 of the planar diaphragm 10, and is mounted between the upper plate 5 and the upper spacer 9. The circuit board 3 is set on top of the upper plate 5. The circuit board 3, upper plate 5, magnet support structure 8, upper spacer 9, planar diaphragm 10, lower spacer 19, and lower plate 15 are fastened together successively. For example, a fastener may be passed through a plurality of aligned holes 105 disposed in the circuit board 3, upper plate 5, magnet support structure 8, upper spacer 9, planar diaphragm 10, lower spacer 19, and lower plate 15 respectively for fixation. In this embodiment, two screws 14 as fasters pass through the aligned holes 105 respectively disposed in the above elements and the end of each screw 14 is locked via a nut 12. The micro planar speaker 100 further comprises a damper 16 on its top and a dustproof net 13 at its bottom. The damper 16 is made of a breathable member for further satisfying the frequency response and audio reproduction of the speaker 100. Elastic connectors, such as a pair of springs 4 electrically connect between the circuit board 3 and the planar diaphragm 10.

The micro planar speaker 100 is shaped and configured according to requirements of the sound devices which are used in, such as in a shape of square, ring, ellipse or others. The planar diaphragm 10, spacers 9, 19, plates 5, 15, magnet support structure 8, and circuit board 3 are shaped and configured according to the micro planar speaker 100 accordingly. Numerous alternative arrangements are also deemed suitable and include irregularly shaped micro planar speaker, and as well as the planar diaphragm 10, spacers 9, 19, plates 5, 15, magnet support structure 8, and circuit board 3.

In accordance with the embodiment of the present invention, the planar diaphragm 10, spacers 9, 19, plates 5, 15, magnet support structure 8, and circuit board 3 are circular and are fastened together to form a circular planar speaker 100.

Figure 8:
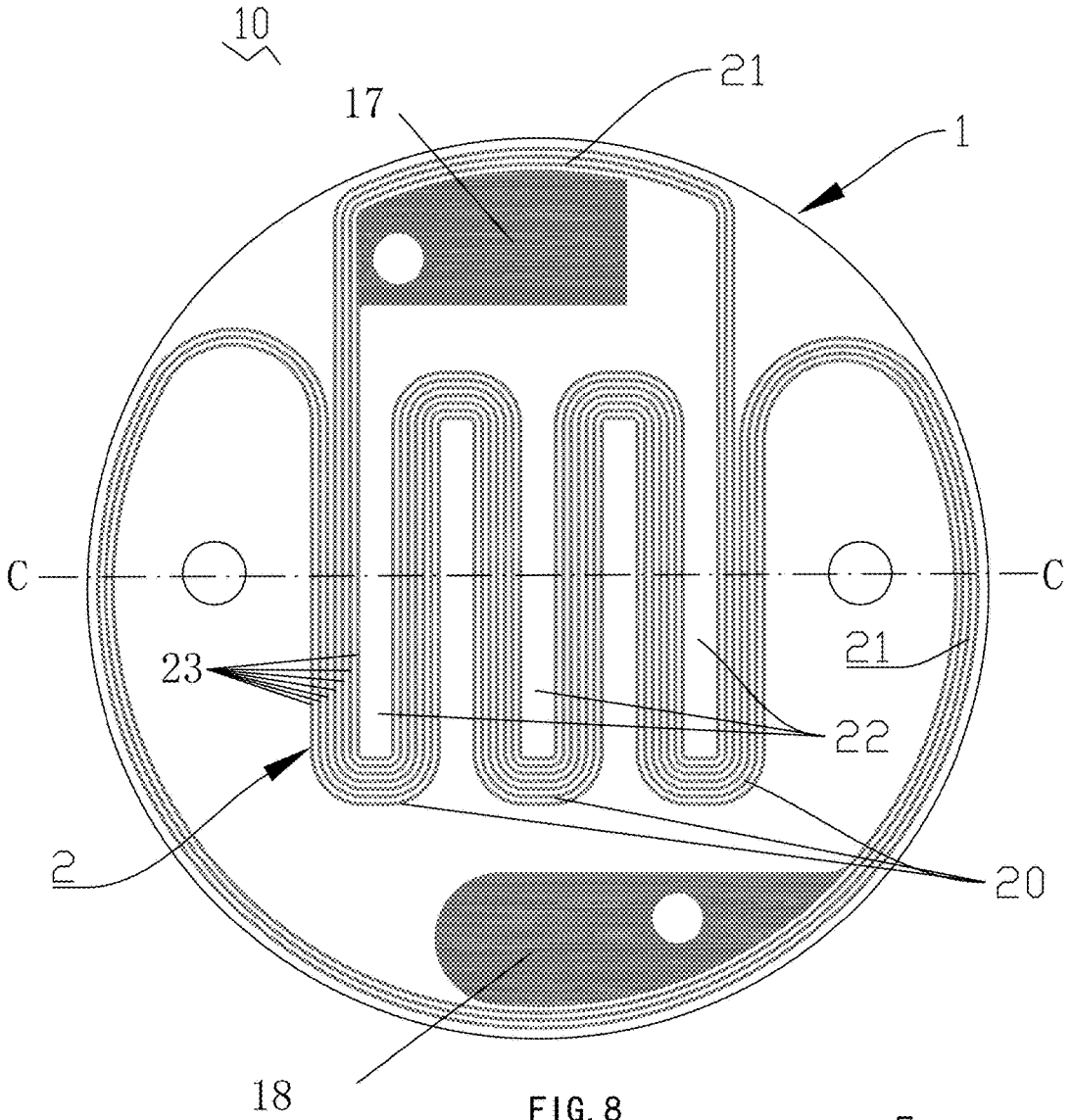
FIG. 8 is a front and enlarged view of a planar diaphragm of the micro planar speaker in accordance with the embodiment of the present invention.
Figure 9:
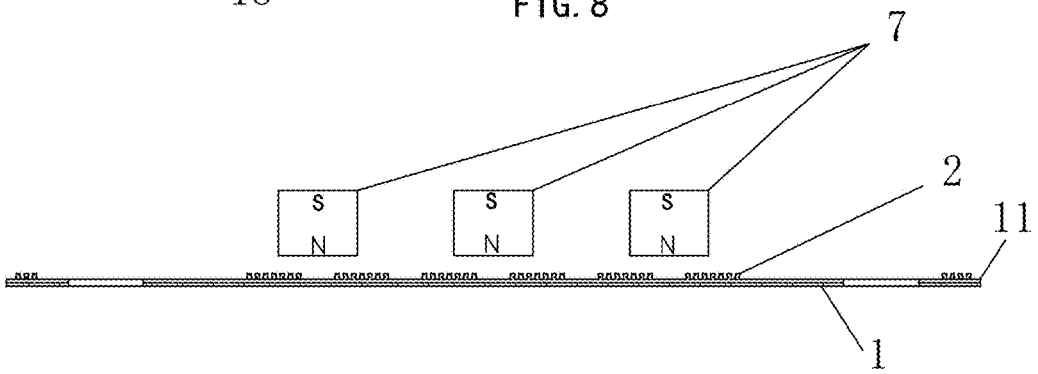
FIG. 9 is a cross-sectional view of the planar diaphragm along the line C-C with polarity arrangement of magnets above the coil conductor.
Figure 10:
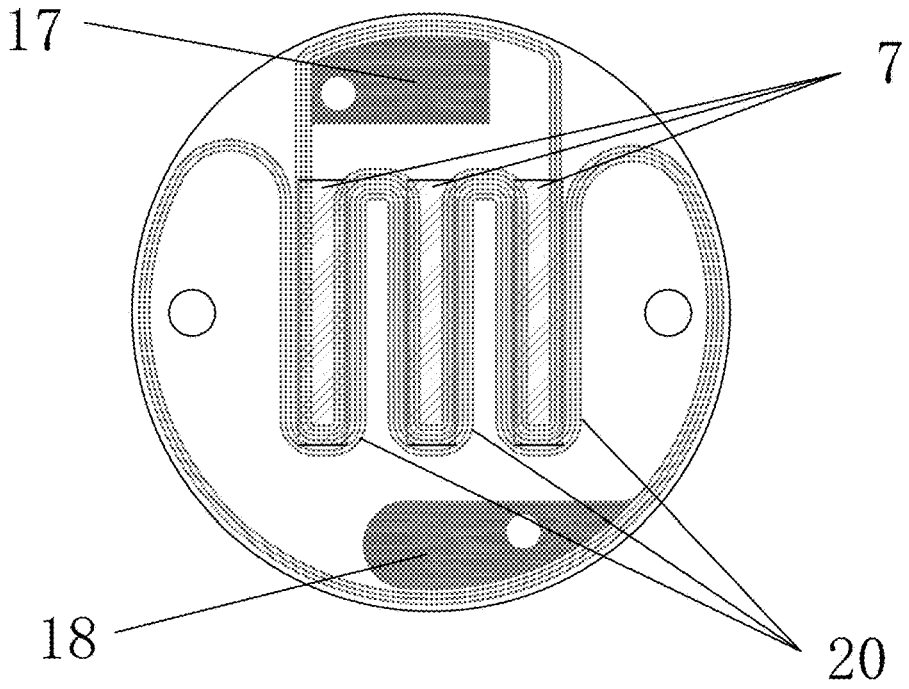
FIG. 10 is a top view of the planar diaphragm with magnets arranged above in accordance with a first embodiment.

Further referring to FIGS. 8-10, the planar diaphragm 10 in this embodiment comprises a vibrating diaphragm 1 and a coil conductor 2. The coil conductor 2 is bonded to a top of the vibrating diaphragm 1 via an adhesive layer 11, namely bonded to the upper side surface 102 of the planar diaphragm 10; and opposite ends thereof form a positive electrode 17 and a negative electrode 18 on the upper side surface 102. The coil conductor 2 is preferably made from copper, such as made from annealed copper or electrolytic copper foil. For example, the coil conductor 2 is made from soft copper with a thickness of 5 micrometers. The vibrating diaphragm 1 is made from a thin film. In a preferable embodiment, the electrolytic copper foil is coated with the adhesive layer 11, and then is applied to the thin film, thereby the planar diaphragm 10 is obtained via laser etching. The coil conductor 2 with a line width of 0.06 mm can be achieved, and a minimum line width of 0.01 mm even can be achieved from soft copper via a micro-etching or laser etching way which benefits from material stability of copper. Thereby, based on such thin line width of the coil conductor 2, the areas of the coil conductor 2 are reduced, a diameter of a circular planar diaphragm 10 and a circular planar speaker 100 can be reduced to 15 mm or less, and thus a micro speaker can be available.

Preferably, the vibrating diaphragm 1 is made from PET film, for example, from PET film with a thickness of 2 micrometers. PET film is such ultra thin which is beneficial for lower-frequency vibration of the speaker 100 and thus increases the frequency spectrum, and also can improve the audio reproduction, thereby, fuller and realer sound is available. The PET film has good toughness and high tensile strength so as to offer the diaphragm 10 in a stable tension, and which renders the speaker a good performance. The planar diaphragm 10 can be manufactured at a total thickness less than 10 micrometers, for example, the vibrating diaphragm 1 is used with PET film at a thickness of 2 micrometers and the adhesive layer 11 has a thickness of 2-3 micrometers. The lighter and thinner coil conductor 2 and vibrating diaphragm 1 of the present invention, improve the vibration and sound of the planar diaphragm 10, and increase the frequency spectrum. The speaker 100 of the present invention has frequency spectrum of 20 Hz-40 KHz and 50 Hz-3 KHz, and has a sound distortion less than 1%.

The coil conductor 2 is a continuous conductive line, and forms a predefined pattern according to the magnets 7 via etching method from annealed copper or electrolytic copper foil. A total length and a line width of the continuous coil conductor 2 is determined by an impedance of the planar speaker 100 and a thickness of the annealed copper or electrolytic copper foil. A layout or pattern of the coil conductor 2 depends on the size of the micro planar speaker in the sound equipments, and also depends on the magnets 7 including the shape, number, arrays and arrangement of magnets 7. The coil conductor 2 forms voice coils 20 each with a pattern and arrangement corresponding to one magnet 7. Each voice coil 20 includes one loop or sets of parallel loops 23 of conductive lines via the coil conductor 2 winding, and defines a space 22 centrally inside the loop or loops 23 of the conductive line. Preferably, the loop or loops 23 have one side thereof open to the space 22, namely, each loop 23 is not closed. The first loop 23 of conductive line in the voice coil 20 is the most inner loop and encloses the space 22. One end of the coil conductor 2 continuously winds to form all first loops 23 of all voice coils 20 one by one, and further winds outer parallel loops 23 sequentially. The most outer loops 23 finally extend to the other opposite end of the coil conductor 2. Loops 23 of the conductive line are spaced each other and preferably equally spaced. The coil conductor 2 forms one or more voice coils 20 according to the number and arrangement of the magnets 7. Each voice coil 20 corresponds to one magnet 7 and together forms one sound unit, and the corresponding magnet 7 is arranged above or below the voice coil 20 preferably in a centrally parallel and aligned way. The corresponding magnet 7 positioned above or below the space 22 of the voice coil 20. Each loop 23 of the conductive line is adapted to an outer contour of the magnet 7 and around the magnet 7. Preferably, the voice coil 20 has a dimension larger than the magnet 7, thus the most outer loop 23 of conductive line located around the outer contour of the magnet 7. The same or smaller dimension of the voice coil 20 relative to the magnet 7 also can be used. The magnets 7 keep all N poles oriented towards the coil conductor 2, or all S poles oriented towards the coil conductor 2. The micro planar speaker 100 can comprises one or more sound unit. The sensitivity of the micro planar speaker 100 is proportional to the number of sound units, dimension of the magnets 7, magnetic field, and the number of loops. The loops 23 are open at one side.

Both opposite ends of coil conductor (or conductive line) 2 are stretched to form the positive electrode 17 and negative electrode 18. Both electrodes 17, 18 are preferably arranged opposite to each other, and each has an enlarged electric area for facilitating electric connection with the circuit board 3 via the spring 4. Further preferably, the positive electrode 17 and negative electrode 18 are located at the edge of the planar diaphragm 10, on the upper side surface 102, which also facilitates electric connection.

In a first embodiment as shown in FIGS. 8-10, the coil conductor 2 is arranged to form three voice coils 20 in shape of letter U aligned to three bar magnets 7 respectively, where the shape, number and arrangement of the voice coils 20 are adapted to and correspond to the magnets 7. The conductor 2 also forms peripheral traces 21 along the edge of the diaphragm 10 for continuously winding the voices coils 20. In this embodiment, each voice coil 20 includes but not limited to seven loops of the conductive line with top side open so as to form a shape of a letter U. Each magnet 7 covers above the space 22, and has a width and length less than those of the coil conductor 2. Each open loop 23 has a shape of letter U.

Figure 11:
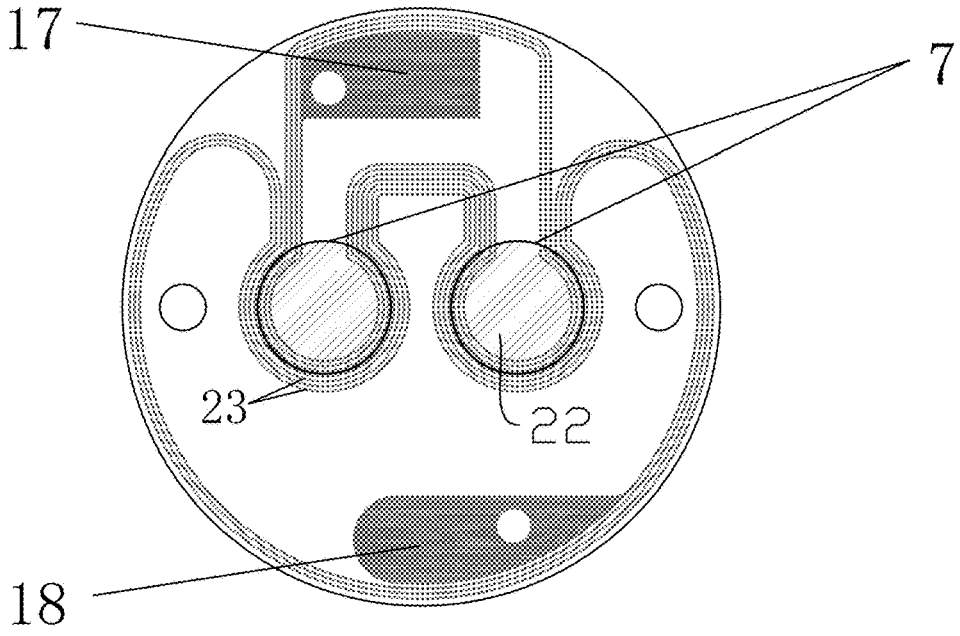
FIG. 11 is a top view of the planar diaphragm with magnets arranged above in accordance with a second embodiment.

In a second embodiment as shown in FIG. 11, the coil conductor 2 is arranged to form two voice coils 20 each with several open and parallel loops 23 in a circular shape aligned to two cylindrical magnets 7 respectively. Each voice coil 20 defines a central space 22. Each magnet 7 covers above the central space 22 of the coil conductor 2. Opposite ends of the continuous coil conductor 2 extend to the positive electrode 17 and negative electrode 18 which have enlarged electric areas.

Figure 12:
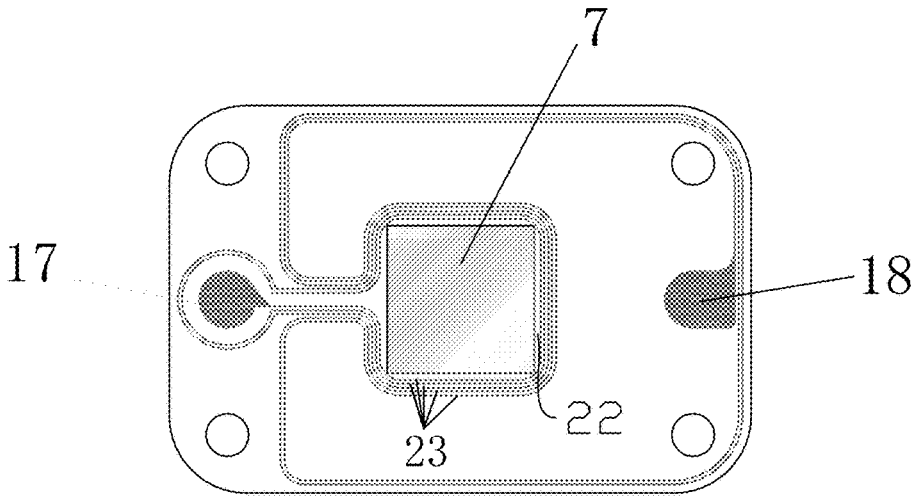
FIG. 12 is a top view of the planar diaphragm with magnets arranged above in accordance with a third embodiment.

In a third embodiment as shown in FIG. 12, the coil conductor 2 is arranged to form one voice coil 20 with several parallel unclosed loops 23 in a square shape aligned to one square magnet 7. The voice coil 20 defines a central space 22. The magnet 7 covers above the central space 22 of the coil conductor 2. The coil conductor 2 continuously winds to form the voice coil 20 and the peripheral traces 21, opposite ends of the continuous coil conductor 2 extend to the positive electrode 17 and negative electrode 18 at the edge of the planar diaphragm 10 and each with an enlarged electric area.

The upper and lower spacers 9, 19 are circular, while the shape is not limited to circular and is adapted to the shape and size of the speaker 100, and each spacer 9, 19 centrally defines the cavity 90 therethrough. Both spacers 9, 19 are made from insulating material and are used to fix the planar diaphragm 10 and form a magnetic gap via the cavity 90 at both side surfaces of the planar diaphragm 10. Preferably, the spacers 9, 19 are made from fiberglass, such as fiberglass board with high mechanical strength. The planar diaphragm 10 is bonded between the upper and lower spacers 9 and 19, and thus keeps planar and maintains a certain tension due to high mechanical strength of the spacers 9, 19, which ensures the planar diaphragm 10 with a stable and consistent frequency response.

The upper and lower plates 5, 15 are circular, while the shape is not limited to circular and is adapted to the shape and size of the speaker 100, and perforations 51 through each plate 5, 15 are provided to allow air and sound waves to pass through. Perforations 51 are communicated with the cavity 90. The upper and lower plates 5, 15 are made from magnetically conductive material such as iron, metal alloy or the like, and can: (a) provide a mounting support for the magnets, (b) close the magnetic circuits between the plates 5, 15, and (c) provide a flat surface to further fix the diaphragm 10.

Several bar magnets 7 can be used and aligned to the voice coils of the coil conductor 2. There are three bar magnets 7 are used in an exemplary illustration in FIG. 5. The bar magnets 7 are mounted in the magnet support 8. The magnet support 8 is circular in this embodiment, but not limited to circular according to the shape and size of the speaker 100, defines a center cavity 82 therethrough which is communicated between the cavity 90 in the upper spacer 9 and the perforation 51 in the upper plate 5. The bar magnets 7 are parallel arranged in the cavity 82 with a space 84 between the bar magnets 7 or between the bar magnet and inner wall of the magnet support 8. The space 84 is communicated with and aligned to the perforation 51 in the upper plate 5 to allow air and sound waves to pass through. The inner wall of the cavity 82 forms fixing grooves 85 for mounting magnets 7. Opposite ends of each bar magnet 7 is mounted in a pair of opposite fixing grooves 85. The magnet support structure 8 is inserted between the upper plate 5 and the upper spacer 9. Preferably, the magnet support structure 8 has its top surface bonded to the flat lower surface of the upper plate 5 to form a whole piece for an easy assembly. The bar magnet 7 also can have its top surface bonded to the flat lower surface of the upper plate 5, and have bottom surfaces extended to the cavity 90 above the upper side surface 102 of the planar diaphragm 10. The magnet support 8 is used to mount the magnets 7.

Figure 3:
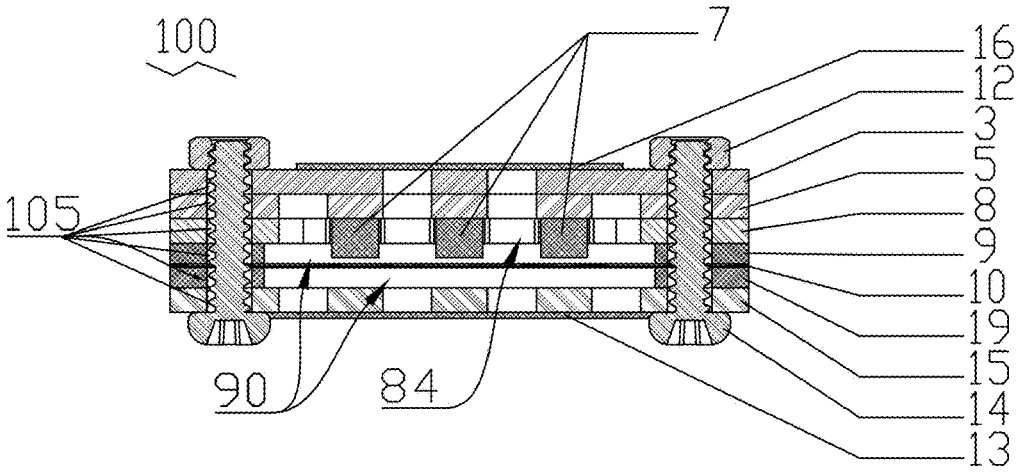
FIG. 3 is a cross-sectional view of the micro planar speaker along the Line A-A of FIG. 1.
Figure 4:
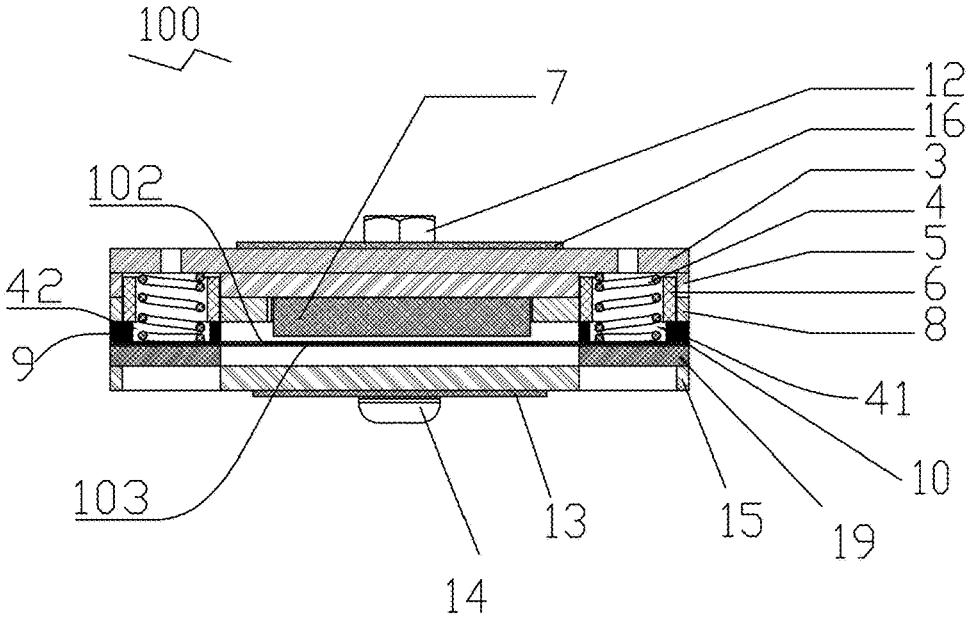
FIG. 4 is a cross-sectional view of the micro planar speaker along the Line B-B of FIG. 1.
Figure 5:
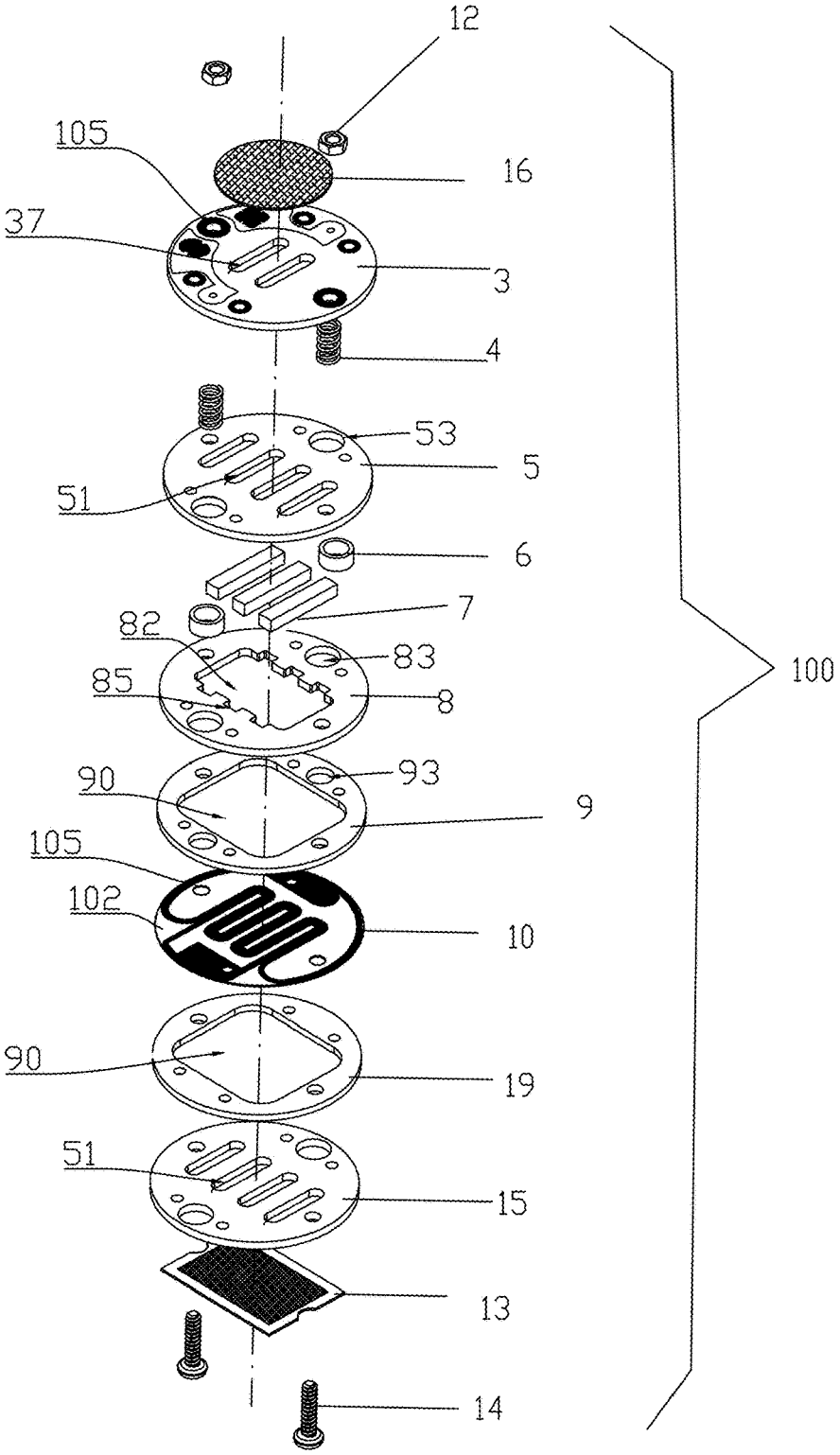
FIG. 5 is an exploded view of the micro planar speaker in accordance with the embodiment of the present invention.
Figure 6:
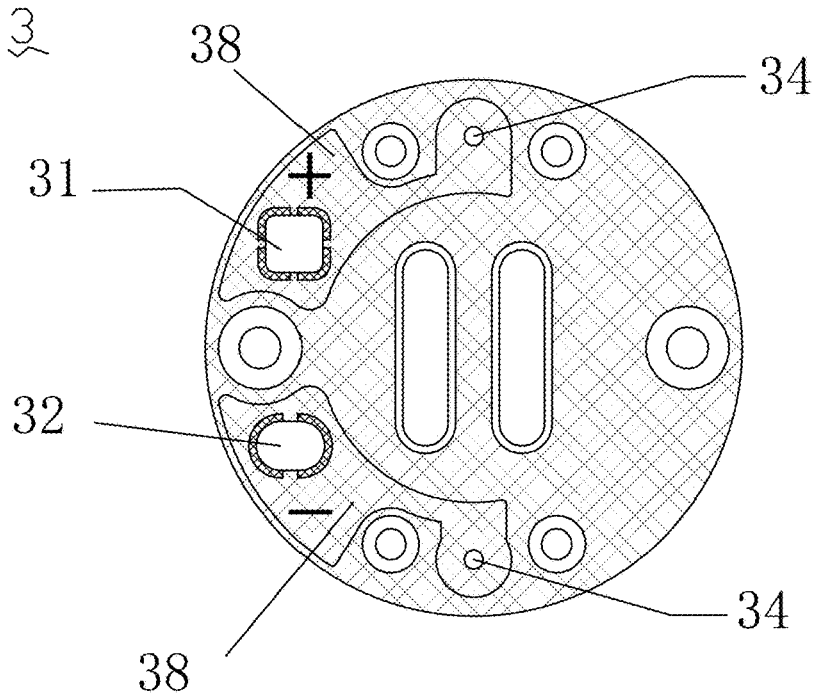
FIG. 6 is a front view of a circuit board of the micro planar speaker in accordance with the embodiment of the present invention.
Figure 7:
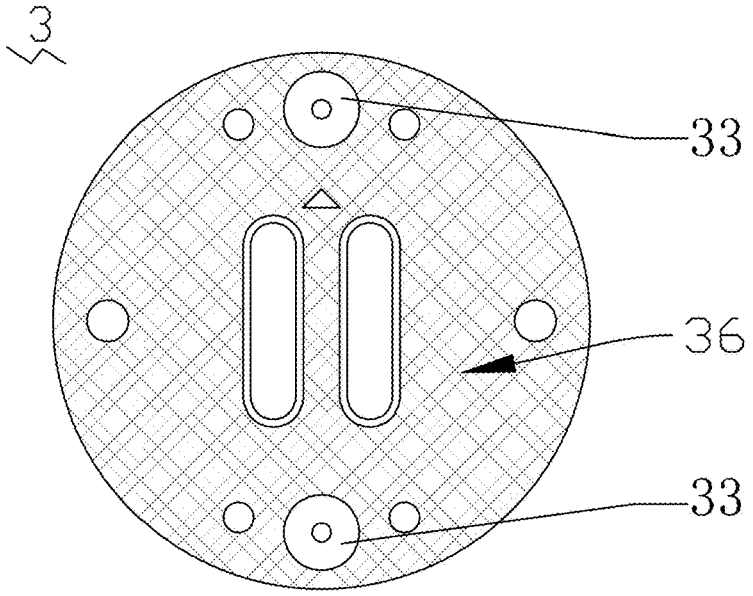
FIG. 7 is a rear view of a circuit board of the micro planar speaker in accordance with the embodiment of the present invention.

FIGS. 3-5 illustrate a single-ended planar-magnetic speaker 100, where only one (upper) side surface of the planar diaphragm 10 is arranged with the magnets 7. There is no magnet 7 set between the planar diaphragm 10 and the lower plate 15. The coil conductor 2 is set only on the same side surface of the planar diaphragm 10 not both side surfaces. The magnets 7 are set above the side surface onto which the coil conductor 2 is stretched and bonded, and face the coil conductor 2 with the same poles. The single-ended planar-magnetic speaker 100 can reduce material cost, facilitate assembling, and make the speaker thinner and lighter.

The circuit board 3 in a circular shape is set on top of the upper plate 5, defines through perforations 37 aligned to perforations 51 in the upper plate 5 to allow air and sound waves to pass through. A positive terminal 31 and A negative terminal 32 are set on a top surface 35 of the circuit board 3 and used for electric connection with the sound equipment in which the speaker 100 is mounted; and preferably, the positive terminal 31 and negative terminal 32 are configured as soldering points for soldering connection; and more preferably, can be treated via gold-plating or immersion-gold process so as to improve electric conductivity. There is a pair of electric contacts 33 are set on a rear surface 36 of the circuit is board 3, and a plated-through hole 34 is defined in each contact 33 through the thickness of the board 3 via which the contact 33 is electrically connected with the inner wall and outer edges of the plated-through hole 34. The positive terminal 31 and negative terminal 32 are respectively connected with one plated-through hole 34 via electric lines 38 on a top surface 35 of the board 3 thus electrically connect with the pair of electric contacts 33 on the rear surface 36 of the board 3. The pair electric contacts 33 are aligned to and face the positive electrode 17 and negative electrode 18 of the planar diaphragm 10. The electric lines 38 is formed by conductive sheet or by etching or printing process, each of which has an area to include the terminals 31, 32 and the plated-through hole 34 therein so as to electrically connect.

Two springs 4 are used for electric connection between the board 3 and the planar diaphragm 10. One spring 4 is used to electrically connect the negative electrode 18 of the coil conductor 2 to the negative terminal 32 of the board 3, and the other spring 4 is used to electrically connect the positive electrode 17 of the coil conductor 2 to the positive terminal 31 of the board 3. The spring 4 can be compression spring, leaf spring or spring plate or the like. Other elastic conductor can also be used to replace spring. Opposite ends of the elastic conductor are respectively and elastically resisted against the rear face 36 and the upper side surface 102 of the planar diaphragm 10. In a detailed embodiment, opposite ends of one spring 4 are respectively resisted against one electric contact 33 of the board 3 and the positive electrode 17 of the coil conductor 2, which forms a positive electric connection from positive electrode 17 to positive terminal 31 via the electric line 38 and plated-through hole 34 from one contact 33. And opposite ends of the other spring 4 are respectively resisted against the other electric contact 33 of the board 3 and the negative electrode 18 of the coil conductor 2, which forms a negative electric connection from negative electrode 18 to negative terminal 32 via the electric line 38 and plated-through hole 34 from the other contact 33. More preferably, the spring 4 is a compressible, spiral spring. The spring 4 can be treated via gold-plating or immersion-gold process so as to improve electric conductivity. A reliable electric connection can be achieved in such way that the compressible spring has both ends tightly and respectively resisted against the contacts and the corresponding electrodes even during the diaphragm 10 vibrating.

In a preferable embodiment, the upper plate 5, magnet support 8 and the upper spacer 9 respectively define through holding holes 53, 83, 93 for holding the spring 4 therein. One set of through holding holes 53, 83, 93 are aligned each other to form one accommodating space 41 for holding one spring 4 and located between one contact 33 and the positive electrode 17. The other set of through holding holes 53, 83, 93 are aligned each other to form the other accommodating space 42 for holding the other spring 4, and located between the other contact 33 and the negative electrode 18.

More preferably, an insulating ring 6 such as a plastic ring, is further set in the accommodating space 41, 42 for fixing and guiding the spring 4. The insulating ring 6 is sleeved around the spring 4, and can avoid short circuit between the spring 4 and the plate 5/magnet support 8. The magnet support 8 is made from electrically conductive materials, such as steel.

The damper 16 of a breathable member is used according to the desired frequency response of the speaker 100 in the sound equipment. The dustproof net 13 is set for preventing dust from outside into the speaker and thus affect its sound nature. The net 13 is made of Nylon net with 50-100 meshes, is bonded to the lower plate 15 to cover perforations 51.

Figure 13:
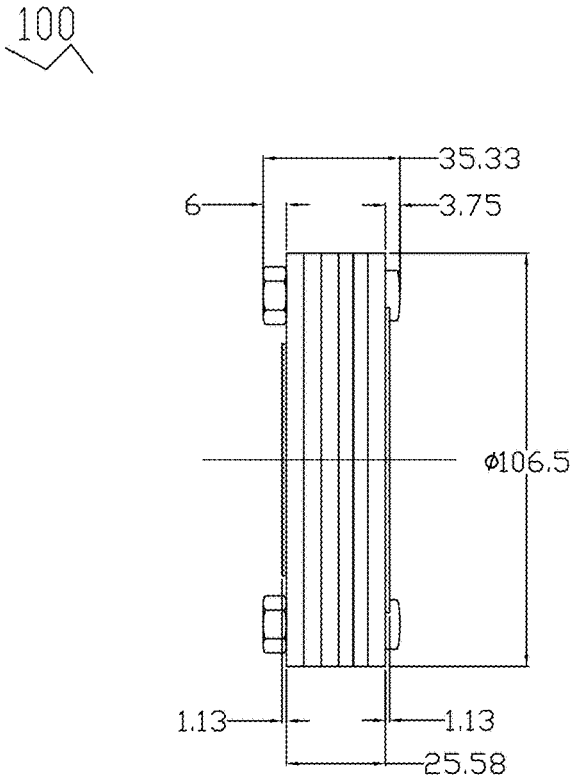
FIG. 13 is a side view of the micro planar speaker in accordance with the embodiment of the present invention.

Referring to FIG. 13 together, the exemplary planar speaker 100 has a height of 35.33 mm including the screw 14 and nut 12, and the height of the board 3, plate 5, 15, magnet support 8, spacer 9, 19 and the planar diaphragm 10 together is 25.58 mm, and the diameter of the speaker is 106.5 mm. In another example, the planar speaker 100 is circular with a diameter of 14.2 mm; wherein the board 3, upper plate 5, magnet support 8 and lower plate 15 each has a height of 0.6 mm; spacers 9, 19 each has a height of 0.5 mm; the planar diaphragm 10 has a thickness of 0.01 mm, nut 16 has a height of 0.8 mm, the cap of the screw 14 has a height of 0.5 mm, whereby a micro planar speaker with a total height of 4.71 mm is achieved, which is suited for such sound equipments as in-ear headphones, mobile phones, and tablet computers. The micro planar speaker 100 of the present invention can get a diameter less than 15 mm and even less than 10 mm, a plane length and width each less than 15 mm and even less than 10 mm, and a height less than 5 mm.

The speaker 100 in accordance with the embodiment of the present invention are advantageous that the coil conductor 2 is made of soft copper or electrolytic copper with good material stability, can be manufactured a complicate conductive line and has a quite small area, which can increase the frequency spectrum, and thus a smaller size of the planar diaphragm 10 can be achieved. Further, the planar speaker 100 in this embodiment adopts a single-ended magnet circuit, so as to become thinner and lighter, to improve manufacturing and assembling efficiency, and also reduce the cost of manufacturing and materials. The positive and negative electrodes 17, 18 of the coil conductor 2 and the positive and negative terminals 31, 32 of the circuit board 3 are respectively electrically connected via compressible springs 4 and electric lines 38 on the board 3 to form positive and negative electric connection, the electric connection is transferred from the rear surface 36 to the top surface 35 of the board 3 via plated-through holes 34, and preferably, the positive and negative terminals 31, 32 of the circuit board 3 form soldering points, in such way to facilitate assembly and electric connection of the speaker in the sound equipment, especially facilitate electric connection by soldering, and thus improve reliability of electric connection. The micro planar speaker 100 of the present invention can keep a good sound quality while has a smaller size and volume, and is suitable for sound equipments such as insert earphones, mobile phones, or tablet computers which require a micro speaker.

Those skilled in the art in possession of this disclosure may now make numerous other modifications of, and departures from, the specific apparatus and techniques herein disclosed without departing from the inventive concepts. It is to be understood that the above-described embodiments and alternative arrangements are only illustrative of the application of the principles of the present invention. Thus, while the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts set forth herein within the spirit and scope of the invention. The disclosure set forth above is not intended to be limiting of the scope of the invention, which is defined by the appended claims.

What is claimed is:

1. A micro planar speaker, comprising:

a planar diaphragm with an upper side surface and an opposite lower side surface;

an upper spacer and a lower spacer respectively disposed at the upper side surface and the lower side surface of the planar diaphragm, and each defining a cavity so as to form a magnetic gap at the corresponding side surface of the planar diaphragm;

an upper plate and a lower plate respectively disposed on top of the upper spacer and below the lower spacer;

one or more magnets; and a circuit board;

wherein the planar diaphragm comprises a vibrating diaphragm and one or more coil conductors; one coil conductor is stretched and bonded onto the vibrating diaphragm via an adhesive layer on one side surface of the planar diaphragm; opposite ends of the coil conductor respectively form a positive electrode and a negative electrode to electrically connect with the circuit boards;

the circuit board defines through perforations communicated with the cavity in the upper spacer to allow air and sound waves to pass through; the circuit board, upper plate, magnet support, upper spacer, planar diaphragm, lower spacer, and lower plate are fastened together successively.

2. The speaker of claim 1, wherein a layout or pattern of the coil conductor is adapted to the magnets, and comprises one or more voice coils via the coil conductor winding; each voice coil corresponds to one magnet to form one sound unit; the magnet is arranged above or below the corresponding voice coil; and the coil conductor is a continuous conductive line.

3. The speaker of claim 2, wherein the layout or pattern of the coil conductor depends on a size of the speaker, and also depends on shape, number, arrays and arrangement of the magnets; each voice coil includes one loop or sets of parallel loops of the conductive line, and defines a space inside the loop or loops.

4. The speaker of claim 3, wherein the loop or loops have one side thereof open to communicate with the space, whereby each loop is unclosed and is open at the same side; each loop is adapted to an outer contour of the corresponding magnet below or upon, and is arranged around the corresponding magnet; and the corresponding magnet is aligned to the voice coil.

5. The speaker of claim 3, wherein a first loop of conductive line in the voice coil is the most inner loop and encloses the space; one end of the coil conductor continuously winds to form all first loops of all voice coils one by one, and further winds outer parallel loops sequentially; the most outer loops finally extend to the other opposite end of the coil conductor; the loops in of the same voice coil are spaced each other, and are equally spaced.

6. The speaker of claim 2, wherein the voice coil has a dimension larger than the magnet; the magnets keep all N poles oriented towards the coil conductor or all S poles oriented towards the coil conductor; the voice coil is in a shape of a letter U according to one or more bar magnets, or the voice coil has unclosed regular shape or unclosed irregular shape according to the magnets.

7. The speaker of claim 1, wherein the positive electrode and negative electrode at opposite ends of the coil conductor are arranged opposite to each other at an edge of the planar diaphragm, and each has an enlarged electric area for facilitating electric connection with the circuit board; and the positive electrode and negative electrode of the coil conductor are arranged on the upper side surface of the planar diaphragm.

8. A micro planar speaker, comprising:

a planar diaphragm with an upper side surface and an opposite lower side surface;

an upper spacer and a lower spacer respectively disposed at the upper side surface and the lower side surface of the planar diaphragm, and each defining a cavity so as to form a magnetic gap at the corresponding side surface of the planar diaphragm;

an upper plate and a lower plate respectively disposed on top of the upper spacer and below the lower spacer;

one or more magnets;

a circuit board; and a magnet support;

wherein the planar diaphragm comprises a vibrating diaphragm and one or more coil conductors; one coil conductor is stretched and bonded onto the vibrating diaphragm via an adhesive layer on one side surface of the planar diaphragm; opposite ends of the coil conductor respectively form a positive electrode and a negative electrode to electrically connect with the circuit board;

the upper and lower plates are made of magnetically conductive material; perforations through each plate are provided to allow air and sound waves to pass through, and are communicated with the cavity in the spacer at the same side surface of the planar diaphragm; and each plate has flat top and bottom surfaces;

the magnet support defines a center cavity therethrough which is communicated with the cavity in the spacer at the same side surface of the planar diaphragm to allow air and sound waves to pass through; and the magnets are parallel arranged in the center cavity with a space therebetween and being communicated with and aligned to the perforation in the plate; the magnet support is mounted between the upper plate and the upper spacer.

9. The speaker of claim 8, wherein the magnet support has its top surface bonded to a lower surface of the upper plate to form a whole piece for an easy assembly.

10. A micro planar speaker, comprising:

a planar diaphragm with an upper side surface and an opposite lower side surface;

an upper spacer and a lower spacer respectively disposed at the upper side surface and the lower side surface of the planar diaphragm, and each defining a cavity so as to form a magnetic gap at the corresponding side surface of the planar diaphragm;

an upper plate and a lower plate respectively disposed on top of the upper spacer and below the lower spacer;

one or more magnets; and a circuit board;

wherein the planar diaphragm comprises a vibrating diaphragm and one or more coil conductors; one coil conductor is stretched and bonded onto the vibrating diaphragm via an adhesive layer on one side surface of the planar diaphragm; opposite ends of the coil conductor respectively form a positive electrode and a negative electrode to electrically connect with the circuit board;

the positive electrode and negative electrode of the coil connector are electrically connected to the circuit board each by an elastic conductor; the circuit board has a pair of electric contacts for electrically connecting with the positive electrode and negative electrode;

the pair of electric contacts is set on a rear surface of the circuit board; a positive terminal and a negative terminal are set on a top surface of the circuit board; the positive terminal and negative terminal are respectively electrically connected with the electric contacts.

11. The speaker of claim 10, wherein the positive terminal and the negative terminal are used for electric connection with a sound equipment in which the speaker is mounted; the circuit board is set on top of the upper plate.

12. The speaker of claim 10, wherein a plated-through hole is defined in each electric contact to form electric conductivity in the plated-through hole and so as to form electric connection between the electric contact and the plate-through hole; the positive terminal and negative terminal are respectively electrically connected with one plated-through hole via electric lines on the top surface of the circuit board and thus electrically connect with the pair of electric contacts on the rear surface of the circuit board.

13. The speaker of claim 10, wherein the positive terminal and negative terminal are configured as soldering points for soldering connection; the positive terminal and negative terminal each has an enlarged electric area for facilitating electric connection; the positive terminal and negative terminal are treated via gold-plating or immersion-gold process so as to improve electric conductivity.

14. A micro planar speaker, comprising:

a planar diaphragm with an upper side surface and an opposite lower side surface;

an upper spacer and a lower spacer respectively disposed at the upper side surface and the lower side surface of the planar diaphragm, and each defining a cavity so as to form a magnetic gap at the corresponding side surface of the planar diaphragm;

an upper plate and a lower plate respectively disposed on top of the upper spacer and below the lower spacer;

one or more magnets; and a circuit board;

wherein the planar diaphragm comprises a vibrating diaphragm and one or more coil conductors; one coil conductor is stretched and bonded onto the vibrating diaphragm via an adhesive layer on one side surface of the planar diaphragm; opposite ends of the coil conductor respectively form a positive electrode and a negative electrode to electrically connect with the circuit board;

the positive electrode and negative electrode of the coil connector are electrically connected to the circuit board each by an elastic conductor; the circuit board has a pair of electric contacts for electrically connecting with the positive electrode and negative electrode;

the electric contacts are respectively aligned to and face the positive electrode and negative electrode of the coil conductor on the planar diaphragm; opposite ends of each elastic conductor are respectively resisted against one electric contact on a rear surface of the circuit board and one of the positive and negative electrodes of the coil conductor on the planar diaphragm.

15. The speaker of claim 14, wherein the elastic conductor is a spring; the spring is a compressible spring, a leaf spring or a spring plate; the upper plate, and/or magnet support and/or the upper spacer respectively define through holding holes for holding the spring therein; one set of through holding holes are aligned each other to form one accommodating space for holding one spring and located between one electric contact and the positive electrode; the other set of through holding holes are aligned each other to form the other accommodating space for holding the other spring and located between the other electric contact and the negative electrode.

16. The speaker of claim 15, wherein an insulating ring is further set around the spring; the micro planar speaker further comprises a damper on its top and a dustproof net at its bottom; the damper is made of a breathable member.

17. The speaker of claim 1, wherein a fastener is passed through a plurality of aligned holes disposed in the circuit board, upper plate, magnet assembly, upper spacer, planar diaphragm, lower spacer, and lower plate respectively for fixation.

18. The speaker of claim 1, wherein the micro planar speaker has a diameter of 15 mm or less, and/or has a length and width each equal to or less than 15 mm, and/or has a height is 5 mm or less; and the speaker has a frequency spectrum of 20 Hz-40 KHz and 50 Hz-3 KHz, and a sound distortion less than 1%; a total thickness of the planar diaphragm can be or less than 10 micrometers.

19. The speaker of claim 1, wherein the coil conductor is made from copper; the vibrating diaphragm is made from a thin film.

20. The speaker of claim 19, wherein the coil conductor is made from annealed copper or electrolytic copper foil via etching way; and the vibrating diaphragm is made from PET film.

* * * * *